United States Patent [19]

Gibot

[11] Patent Number: 4,964,283

[45] Date of Patent: Oct. 23, 1990

[54] ISOTHERMAL CONTAINER WITH RESERVOIR FOR REFRIGERANT AND ITS USE FOR THE TRANSPORTATION OF FRESH PRODUCTS

[75] Inventor: Claude Gibot, Malakoff, France

[73] Assignee: Carboxyque Francaise, Puteaux, France

[21] Appl. No.: 335,677

[22] Filed: Apr. 10, 1989

[30] Foreign Application Priority Data

Apr. 8, 1988 [FR] France ..... 88 04659

[51] Int. Cl.[5] ..... F25D 3/12

[52] U.S. Cl. ..... 62/384; 62/387; 62/388

[58] Field of Search ..... 62/384, 388, 239, 243, 62/387

[56] References Cited

U.S. PATENT DOCUMENTS

| | | | |
|---|---|---|---|
| Re. 20,215 | 12/1936 | Wooll | 62/384 X |
| 1,997,936 | 4/1935 | Kiesel, Jr. . | |
| 1,998,681 | 4/1935 | Littleford, Jr. . | |
| 2,057,058 | 10/1936 | Rice, Jr. | 62/387 |
| 4,206,616 | 6/1980 | Frank et al. | 62/384 X |
| 4,498,306 | 2/1985 | Tyree, Jr. | 62/384 X |

FOREIGN PATENT DOCUMENTS

| | | |
|---|---|---|
| 0166086 | 1/1986 | European Pat. Off. . |
| 2178437 | 11/1973 | France . |
| 2188122 | 1/1974 | France . |

*Primary Examiner*—Lloyd L. King

*Attorney, Agent, or Firm*—Young & Thompson

[57] ABSTRACT

The present invention relates to an isothermal container with isothermal walls comprising a thermally conducting reservoir (10) for refrigerant product disposed in the upper part of the container; a baffle (3) of thermally insulating material, of a size slightly less than the internal section of the container and having about its periphery an annular space (8) suitable for the free passage of the gas is disposed horizontally below the reservoir (10), at a distance sufficient to delimit in the upper part of the container a region (6) suitable for natural convective heat exchange; the reservoir (10) and the baffle (3) comprising securement and support means (4, 12, 13, 14) in the container (1), characterized in that it computes at least one food compartment (c) disposed in the container, below the plate forming a baffle, of a size substantially less than the internal volume of the container, a space remaining free about the compartment (c) in the container.

10 Claims, 1 Drawing Sheet

Figure 2:
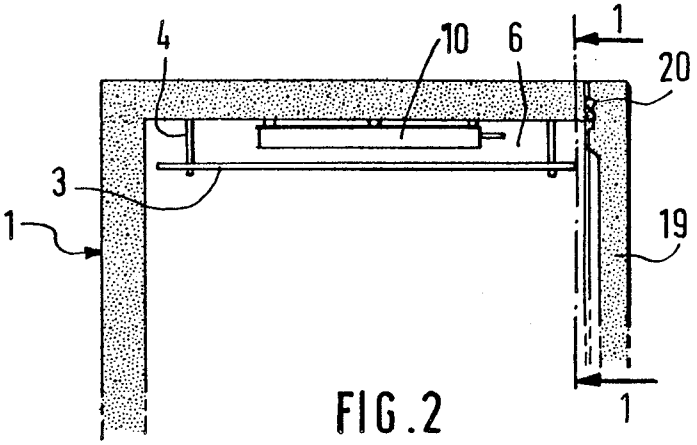

ISOTHERMAL CONTAINER WITH RESERVOIR FOR REFRIGERANT AND ITS USE FOR THE TRANSPORTATION OF FRESH PRODUCTS

The present invention relates to an isothermal container, particularly a movable trolley adapted to transport fresh products, useful for example for the transporting of plates of food.

There is disclosed in U.S. Pat. No. 1,997,936 of Oct. 10, 1982 (KIESEL) an isothermal container with isothermal walls comprising a reservoir for refrigerant product, disposed in the upper portion of the container; a baffle plate of thermally insulating material, leaving spaces suitable for the free passage of gas is disposed horizontally below the reservoir.

The present invention relates particularly to trolleys for the transportation of fresh products which can be used particularly to stock and transport these fresh products and for example meals before their distribution in aircraft, trains, or hospitals and at temperatures appropriate to the preservation of the fresh products, that is to say about 0° C. These isothermal containers are in this case slightly heat insulating, of lightweight structure, for example comprising only one double wall, and are disposed or mounted fixedly on transportation means, such as carriages or casters or a series of casters for example.

However, the applicant has discovered that to carry out for example transportation for a long time (30 hours) without freezing the products given the doses of solid $CO_2$ used, a supplemental device is needed. This is why the present invention relates to a container, particularly a movable trolley, for the transportation of fresh products, with isothermal walls of the type comprising a reservoir for a refrigerating product in which the reservoir is disposed in the upper portion of the container, and in which a baffle of thermally insulating material, of a size slightly less than the internal section of the container and leaving about its periphery an annular space suitable for the free package of the gas is disposed horizontally below the reservoir, at a distance sufficient to delimit in the upper portion of the container a region suitable for heat exchange by natural convection, and in which the reservoir and the baffle comprise securement and/or support means in the container, characterized in that it comprises at least one compartment for food disposed in the container, below the plate forming the baffle, of dimensions substantially less than the internal volume of the container, a space remaining free about the compartment in the container.

Preferably, there is used as refrigerating product solid carbon dioxide stored within the reservoir.

The invention has the following advantages:

the products stored adjacent the reservoir are protected from radiation and therefore very low temperatures by the baffle which forms a thermal barrier;

the sublimation gases may flow along the walls of the container, in the free space left between the baffle and the internal vertical walls. During sublimation, the cold gases descend toward the base of the container while exchanging their refrigeration proportionally. The warm atmosphere of the container rises by natural convection and enters the region of heat exchange by natural convection, particularly between the baffle and the reservoir of refrigerating product, where it is cooled.

The refrigerating product is thus a cooling agent having a thermally conductive heat exchange surface which radiates and which permits ensuring the permanent cooling of the region by natural convection.

The food compartment may be removable or not. There remains a free space abOut the compartment within the container. The cold gas flowing along the walls of the container flows also along the walls of the compartment and cools it in a uniform manner. The double envelope provided plays the role of a new thermal barrier of low insulating power, but compensated by the fact that the gas/solid heat exchange (without circulation) has a low coefficient of heat transfer.

In the case of the transportation of plates of food for example, the fresh products may be stored if desired on several plates disposed in the food compartment.

The food compartment may be open, for example, forwardly and rearwardly to permit easy loading and unloading of the cold product, and in this case the refrigerant gases are in contact with the fresh products throughout storage. It could also be hermetically sealed.

Carbon dioxide is however incompatible with the good preservation of certain fresh products. This is why, in this case, the food compartment should be hermetically sealed.

There is disposed within the container a structure of brackets of food-quality polyethylene permanently secured to the walls of the container. This internal structure permits loading the products to be transported without special precaution, its role being essentially to ensure the circulation of gaseous $CO_2$ about the product whether or not the container is provided with a double envelope. The double envelope formed by a hermetically-sealed metallic shell of thin sheet metal will be disposed on the internal structure of the isothermal container, that is on its lower brackets and between the lateral brackets, and its sealing ensured in front, on the loading side, by a metal door secured to the isothermal door of the container.

In this case, the door may also be provided with a plate fixed on its internal surface, the plate being spaced from the internal surface of the door to ensure a double envelope, the sealing of the compartment being then guaranteed by a lip joint. This joint permits ensuring sealing of the compartment even when excess $CO_2$ escapes through the door when leaving the container.

As will be seen from the following, the containers according to the invention will fill completely the requirements of temperature, temperature stability during storage, and temperature uniformity for the preservation of fresh products.

That is why the present invention relates also to the use of these containers for the conservation of products at temperatures near 0° C.

Figure 3:
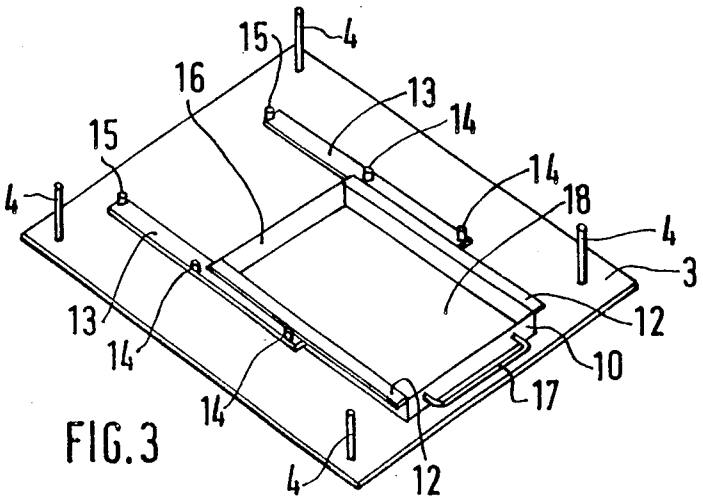
Figure 1:
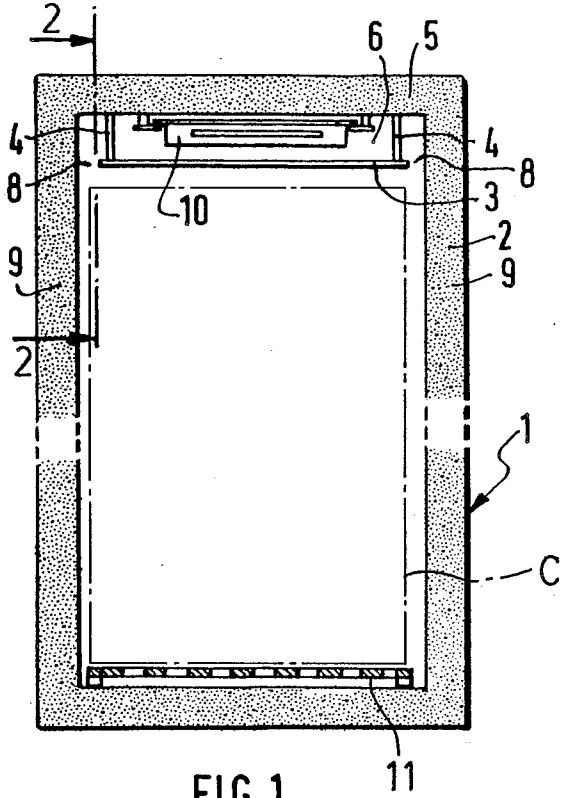

Other characteristics and advantages of the present invention will appear from a reading of the following detailed description and with reference to the accompanying drawings which show:

in FIG. 1 a front view in section on line 1—1 of FIG. 2, of a container according to the invention;

in FIG. 2 a partially sectioned side view on line 2—2 of FIG. 1, of the same container;

in FIG. 3 a perspective view of the assembly of the reservoir and the baffle according to the invention.

As is seen in FIG. 1, the parallelepipedal container 1 is constituted by walls provided with insulating material 2. A plate of polyethylene 3 forming a baffle is suspended by four suspension rods 4 from the upper wall 5 of the container 1. This plate forming baffle 3 delimits a region 6 suitable for natural heat exchange in which the hot gases which rise from the bottom of the container through free space 8 between baffle 3 and vertical walls 9 of the container are cooled by passage between the baffle 3 and the reservoir 10 of refrigerant product.

Usually, the containers comprise also in their lower portion a grid 11 or brackets of plastic material, for example of polyethylene on which are disposed the fresh products to be transported, e.g. in at least one food compartment (c) disposed in the container, below the plate forming a baffle (3), of a size substantially less than the internal volume of the container, a space remaining free about the compartment (c) in the container.

In FIG. 2 is shown in section, and side view the same container 1 having the baffle 3 suspended by rods 4 and the reservoir 10 disposed in the region 6.

In this side view is shown a door 19 of the container 1, also thermally insulated, the door 19 being provided with door joints 20 insuring sealing.

In FIG. 3 is shown in perspective the baffle 3 and the reservoir 10 as they are disposed in the upper portion of the container to comprise the region of natural convection. The plate comprising baffle 3 is provided as described above with four suspension rods 4. The reservoir 10 is a drawer of stainless steel 304L provided with slides 12 adapted to slide in translation on slideways 13 parallel to the drawer and themselves provided with suspension lugs 14 from the upper wall 5 of the container 1.

The lugs 15 located at the end of the slideways 13 on the side of rear wall 16 of reservoir 10 form an abutment. The reservoir 10 is provided, on the side opposite rear wall 16, with a handle 17 permitting the user to move the drawer in translation during filling or to control the level of refrigerant product. The bottom 18 of the reservoir 10 is located at a distance of several centimeters from the baffle 3. An appropriate region of convection is defined in the upper part of the container for example if the bottom 18 of the reservoir 10 is about midway between the baffle 3 and the upper wall of the container in which are fixed the lugs and suspension rods (4, 14, 15).

As a modification, two superposed plates could be provided, separated by spacer rings. As the material for these plates, expanded PVC is suitable.

Tests have been conducted with a container according to the invention. The reservoir 10 is a drawer of stainless steel 304L of internal dimensions (in millimeters) 500×420×50 (thickness 12/10). The baffle 3, a plate of polyethylene of a thickness of 10 mm, is suspended at 100 mm and the drawer is suspended at 10 mm from the wall 5. The free space 8 is 30 mm at its front and rear and 55 mm at its sides.

The temperature between the drawer-reservoir provided with solid $CO_2$ and the thermal barrier which forms the plate-baffle is −18° C. on the average; the temperatures measured in the container away from this region remain above −5° C., with a range between the top and the bottom of the container of the order of 2° C. Tests were conducted for more than 5 hours at ambient temperatures of about 15° C. The stored products in the container remained between 0.5° and 2° C.

I claim:

1. An isothermal container having isothermal walls defining an inner cavity partitioned by a thermally insulating baffle means into an upper chamber having a top wall and a lower chamber adapted to receive at least one service compartment having outer transverse dimensions substantially less than the corresponding inner transverse dimensions of said lower chamber, said baffle means being suspended from said top wall of said upper chamber and being so dimensioned to define a passage peripherally about said baffle means establishing a free communication between said upper and lower chambers, and means on said top wall of said upper chamber for supporting a refrigerant reservoir of a thermally conducting material, said reservoir having a bottom and so dimensioned to leave free between said bottom and said baffle means a region suitable for gas heat exchange by natural convection.

2. The container of claim 1, wherein said reservoir is releasably supported on said top wall.

3. The container of claim 2, wherein said reservoir is a drawer having slide surfaces for cooperation with slideways of said supporting means.

4. The container of claim 1, wherein said baffle means is constituted of at least one plate of plastic material.

5. The container of claim 2, wherein said reservoir is made of stainless steel.

6. The container of claim 3, further comprising a hinged isothermal door giving access to both said upper and said lower chambers.

7. The container of claim 1, wherein said peripheral passage has a width comprised between 30 and 60 mm.

8. The container of claim 7, wherein said bottom of said reservoir is substantially midway between said baffle means and said top wall and parallel thereto.

9. The container of claim 1, in which the breadth and the depth of the baffle means occupy most of the breadth and the depth of the interior of the container.

10. The container of claim 9, in which the baffle means is a single baffle.

* * * * *